US005812632A

United States Patent [19]

Schardt et al.

[11] Patent Number: 5,812,632

[45] Date of Patent: Sep. 22, 1998

[54] X-RAY TUBE WITH VARIABLE FOCUS

[75] Inventors: Peter Schardt, Roettenbach; Erich Hell, Erlangen, both of Germany

[73] Assignee: Siemens Aktiengesellschaft, Munich, Germany

[21] Appl. No.: 937,691

[22] Filed: Sep. 29, 1997

[30] Foreign Application Priority Data

Sep. 27, 1996 [DE] Germany ..... 196 39 920.3

[51] Int. Cl.[6] ..... H01J 35/04

[52] U.S. Cl. ..... 378/137; 378/138

[58] Field of Search ..... 378/138, 137

[56] References Cited

U.S. PATENT DOCUMENTS

| | | | |
|---|---|---|---|
| 3,732,426 | 5/1973 | Shimizu | 313/97 |
| 5,313,510 | 5/1994 | Ebersberger et al. | 378/137 |
| 5,581,591 | 12/1996 | Burke et al. | 378/135 |
| 5,617,464 | 4/1997 | Mika et al. | 378/137 |

FOREIGN PATENT DOCUMENTS

| | | |
|---|---|---|
| 0 127 983 | 12/1984 | European Pat. Off. . |
| 28 50 583 | 6/1980 | Germany . |

*Primary Examiner*—Don Wong
*Attorney, Agent, or Firm*—Hill & Simpson

[57] ABSTRACT

An x-ray tube has an evacuated housing in which an electron-emitting cathode is rigidly mounted and a rotating anode having an anode dish rotatable by a drive arrangement, which is struck by the electron beam, accelerated with an electrical field, for producing x-rays. An electromagnetic system for the deflection and focusing of the electron beam has a number of current-permeated coil elements. The cathode generates a rotationally-symmetrical circular beam, and the rotational axis of the anode dish is offset from and parallel to the axis of the electron beam by the average radius of the anode dish edge. The electromagnetic system generates a dipole-free quadrupole field that deforms the electron beam cross-section.

13 Claims, 2 Drawing Sheets

X-RAY TUBE WITH VARIABLE FOCUS

BACKGROUND OF THE INVENTION

1. Field of the Invention

The present invention is directed to an x-ray tube of the type having an evacuated housing in which an electron-emitting cathode—rigidly connected thereto—and a rotatable anode are disposed, the anode having an anode dish which is struck by the electron beam, accelerated with an electrical field, and having an electromagnetic system for the deflection and focusing of the electron beam.

2. Description of the Prior Art

High-performance x-ray tubes for medical diagnostics are constructed either as rotating bulb tubes, wherein the cathode and the anode are rigidly connected to the housing and rotate together with the x-ray tube during operation of the x-ray tube, or according to the rotating anode principle, wherein the housing and the cathode are stationary and only the rotating anode is driven in rotating fashion in the housing. The embodiment of the anode essentially determines the loadability of the tube. Two competing demands are made on the anode. First, the pre-condition for a high MTF (modulation transfer function) should be satisfied with a small focal spot, but a high x-ray flux is desired for minimizing the exposure times. The two demands, however, cannot be simultaneously met, so that the physician must set the best possible compromise between resolution and x-ray power dependent on the particular application. A number of focal spot sizes are available to the physician for selection in modern x-ray systems, with two or three sizes usually currently provided. It is a technical problem to provide a structure which allows the various focal spot sizes to be realized.

Some modern x-ray tubes have special focus heads in which a separate tungsten helix is installed for each focal spot size. Different focal spots are then realized by switching the helix. The calculation and fabrication of these focus heads, however, is extremely complicated and the number of types is extremely large. Moreover, narrow tolerances must be very exactly adhered to since there is no longer any possibility for correcting the focal spot size in the finished tube.

SUMMARY OF THE INVENTION

An object of the present invention is to provide an x-ray tube with a rotating anode such that, given a relatively simple structure, a focal spot which is variable in terms of size and shape within a broad range can be generated during operation in the form of a line focus on the anode.

This object is achieved in an x-ray tube in accordance with the invention wherein the cathode generates an electron beam having a circular cross-section, wherein the rotational axis of the anode dish is offset parallel relative to the axis of the electron beam by the average radius of the anode dish edge, and wherein an electromagnetic system generates a dipole-free quadrupole field that deforms the cross-section of the electron beam.

Since the axis of the electron beam is offset relative to the rotational axis of the rotating anode and the quadrupole field is dipole-free, the electron beam coming from the cathode in a straight propagation direction strikes the inclined anode dish edge of the rotating anode without being deflected. The quadrupole field only serves the purpose of focusing the initially circular electron beam in a first direction and defocusing it in a second direction perpendicular to the first direction. After passing through a quadrupole field with the focusing strength 1/f and a drift path having the length L, an electron beam with a circular cross-section having the expanse x=y=r becomes an electron beam with an approximately elliptical cross-section having the dimensions $x=r\cdot(1-L/f)$ and $y=4\cdot(1+L/f)$.

In order to be able to adapt the modification of the cross-sectional shape of the electron beam caused by the quadrupole field to different requirements, an arrangement for setting the field strength of the dipole-free quadrupole field can be provided.

When the electromagnetic system lies at ground potential, it fulfills the function of an acceleration electrode. If all coil elements of the electromagnetic system, which contains a number of coil elements, are connected parallel with proper polarization and exhibit suitable numbers of turns, the coil elements can be driven by a D.C. source. The electromagnetic system may also produce the wobble of the focal spot, as is necessary for a tube in a CT system, by superimposing an alternating current for wobbling the focal spot on the direct current supplied to at least one coil element for generating the quadrupole field.

In an embodiment of the invention the housing has a shoulder offset parallel to the rotating anode axis for acceptance of the cathode with a constriction for the coil elements. This design allows the coil elements for generating the quadrupole field to be arranged extremely close to the axis of the electron beam, so that a strong quadrupole field can be achieved with comparatively low current intensities and with coils that are not excessively large. Since the electron beam proceeds substantially on a straight line to the anode dish edge, only a slight inside diameter of the shoulder is required in the region of the constriction.

The coil elements for the quadrupole field can be arranged at a common carrier fashioned as a ring that at least partially surrounds the housing, as a substantially cylindrical, which preferably is a divided ring.

Further, the carrier, particularly in the form of an iron yoke, can have pole projections extending toward the housing, the coil elements being secured to these pole projections.

DESCRIPTION OF THE PREFERRED EMBODIMENTS

Figure 1:
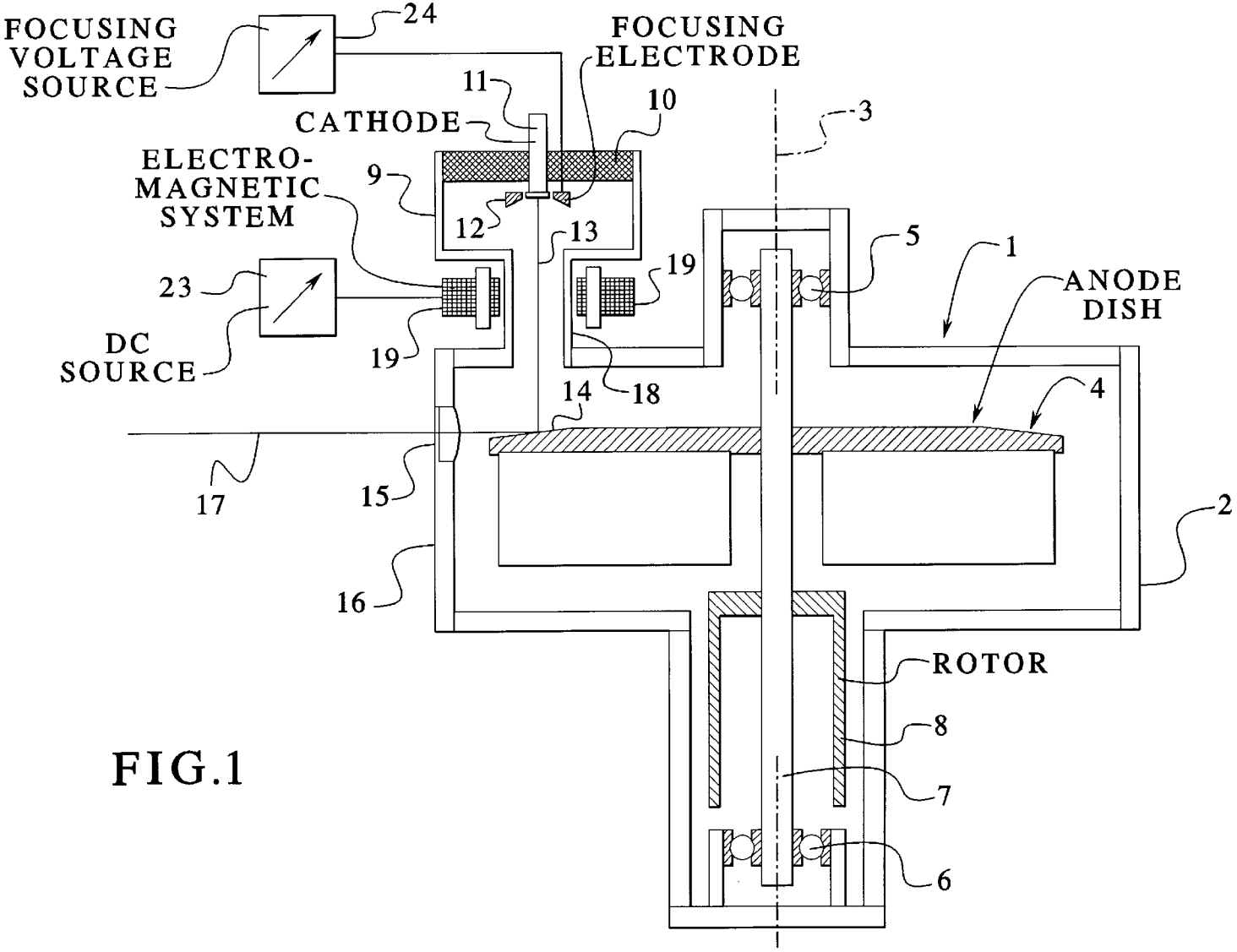
FIG. 1 is a schematic illustration of an inventive rotating anode x-ray tube with an electromagnetic system.

FIG. 1 shows a rotating anode x-ray tube having a stationary, evacuated housing 2 in which the anode dish 4 of the rotating anode is seated so as to be rotatable around a rotational axis 3. Ball bearings 5 and 6 are provided for the rotational bearing of the shaft 7 of the anode dish 4. The rotor of the drive system for the anode dish 4 is referenced 8. The stator of the drive system is located outside the housing 2 and is not shown in FIG. 1.

A shoulder 9, i. e. a cup shaped section of housing 2, that contains the cathode 11 seated in a cathode insulator 10 and the focusing electrode 12, is mounted to the housing 2 offset relative to the rotational axis 3. The electron beam generating system comprising the cathode 11 and the focusing electrode 12, which can be constructed in the fashion of a known Pierce electron gun, generates an electron beam 13 having a circular cross-section. Due to the offset of the shoulder 9 relative to the rotational axis 3, the electron beam 13 strikes the oblique annular anode dish edge 14, i. e. the truncated cone shaped boundary zone, of the anode dish 4 and generates the x-rays 17 thereat which emerge from the beam exit window 15 of the side wall 16 of the housing 2. The shoulder 9 is provided with a constriction 18 around which an electromagnetic system 19 for generating a dipole-free quadrupole field is arranged in order to focus the initially circular cross-section of the electron beam 13 in one direction and to defocus it in another direction, so that the focal spot of the x-ray tube can be continuously set within broad limits on the basis of simple parameters controllable from the outside. A focal spot according to IEC-Standard 336 can be generated for every application by the variation of the focusing voltage across the focusing electrode 12 (i. e., the size of the cross-sectional area of the electron beam, or the encompassed area of the focal spot can be varied) and dependent on the field strength of the quadrupole field (i. e., length/width ratio of the cross-section of the electron beam, or of the focal spot can be varied).

In order to be able to set the encompassed area of the focal spot as needed, the focusing electrode 12 has a focusing voltage source 24 allocated to it that charges the focusing electrode 12 with a variable focusing voltage, the adjustability of the focusing voltage being indicated by an arrow allocated to the focusing voltage source 24.

Imprecisions in the manufacturing process of the electron beam generating system which may exist can be at least partially subsequently corrected electrically via the focusing voltage and the quadrupole field, leading to a reduction of the reject rate.

The electromagnetic system 19 for generating the dipole-free quadrupole field includes a carrier 20 at ground potential in the form of a cylindrically and circularly fashioned iron yoke having four radially projecting pole projections 21 arranged at its interior. These pole projections 21 are uniformly spaced from one another by respective angles of 90° and have a generally rectangular cross-section. The spacing of the pole projections 21 lying opposite one another is dimensioned such that it just corresponds to the outside diameter of the cylindrical constriction 18 of the shoulder 9, since the carrier 20 is to be arranged around this region. This requires that the carrier 20 be divided (in a way not shown) and, after being attached in the constriction 18, the parts of the carrier 20 are held together with suitable means that are likewise not shown. Respective coil elements 22 are provided at the ends of the pole projections 21, these being only schematically illustrated in FIG. 2. These coil elements 22, which can also be composed of a single turn, have direct current flowing through them and serve the purpose of generating the quadrupole field that serves for variation of the cross-section of the electron beam.

Figure 3:
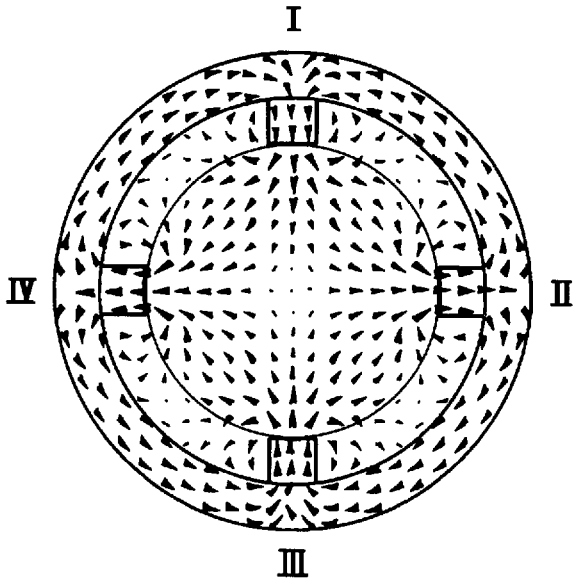
FIG. 3 shows the quadrupole field generated by the aforementioned electromagnetic system.

This quadrupole field is shown in FIG. 3. The poles I and II therein are north poles and the poles II and IV are south poles. The generated quadrupole field has the property of defocusing the electron beam in one direction, i.e. the electron beam is pulled apart in one direction, and of compressing it in the direction perpendicular thereto, so that its width is reduced. The realization of a focal spot in the form of a line focus is possible in this way. The cross-sectional area of the electron beam thereby does not change, merely the ratio of length to width. The size of the cross-sectional area of the electron beam, however, can be set with the focusing voltage source 24.

Generally, the electromagnetic system 19 is arranged so that the line-shape focal spot (line focus) formed on the anode dish edge 14 proceeds radially with reference to the rotational axis 3 of the anode dish 4.

For example, the electromagnetic system 19 can be constructed such that

- the coil elements 20 are connected in series for realizing north and south poles (FIG. 3), taking their respective winding sense into consideration;
- the number of turns of the coil elements 20 allocated to the south poles are equal in size;
- the number of turns of the coil elements 20 allocated to the south poles are equal in size; and
- the coil elements 20 connected in series, as indicated in FIG. 1, are supplied by a DC source 23 that supplies a direct current whose current strength is variable, for varying the field strength of the quadrupole field, and thus the area of the focal spot, as indicated by an arrow allocated to the DC source 23.

The length/width ratio of the focal spot can then be influenced by the intensity of the current; the focal spot becoming longer as the intensity of the current increases. The length/width ratio existing with a given minimum value of the current intensity can be influenced by the ratio of the number of turns of the coil elements 20 present at the south poles and at the north poles.

If a wobble of the focal spot is to ensue in a tangential direction on the anode dish edge 14, as is desirable, for example, in computed tomography, the aforementioned series circuit of all coil elements is not used. Instead, separate direct current sources 25 and 26 are then required—dependent on the desired adjustment direction—for the coil elements 20 belonging to the two north and south poles in the way indicated schematically in FIG. 4, these direct current sources 25 and 26 being modulated with a signal from an alternating current source 27. The modulation ensues anti-phase as a consequence of an inverter 28 connected between the DC voltage source and the alternating voltage source 27. The amplitude of the alternating current determines the amplitude of the displacement of the focal spot, and the frequency of the alternating current determines the frequency with which the focal spot is displaced.

The two other coil elements 22 in the described exemplary embodiment are supplied from a common DC current source 29.

Figure 2:
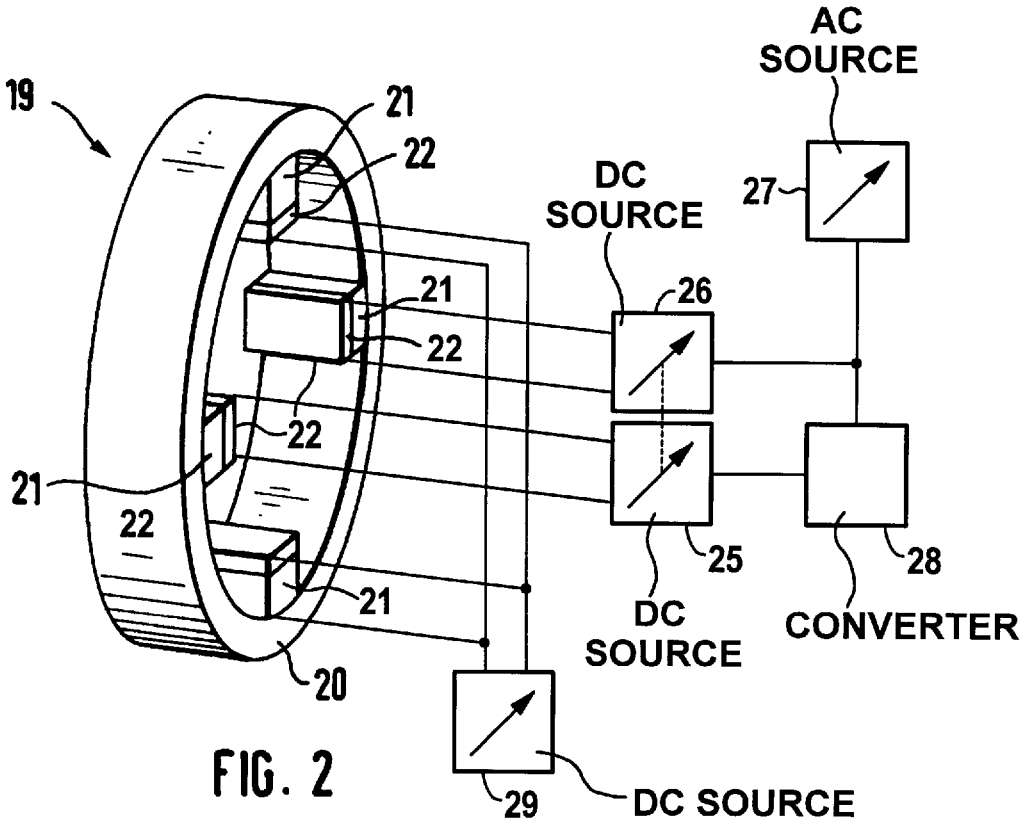
FIG. 2 is a perspective view of the electromagnetic system of the x-ray tube of FIG. 1.

The current intensities of the direct currents supplied by the DC sources 25, 26 and 29 are adjustable, as indicated by appropriate arrows allocated to the DC sources 25, 26 and 29. The adjustment of the intensities of the currents of the direct currents output by the DC sources 25 and 26 ensues such that these current intensities—apart from the differences effected by the anti-phase modulation with the alternating current source 27—are always the same, as illustrated in FIG. 2 by the arrows illustrating the adjustability of the intensities of current of the DC sources 25 and 26 being connected to one another with a broken line.

The carrier 20 with the pole projections 21 is formed of laminated or solid iron or of ferrite.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray tube comprising:

an evacuated housing;

a cathode rigidly mounted in said evacuated housing, said cathode emitting an electron beam having a substantially circular cross-section, and propagating along a beam axis;

a rotating anode having an anode dish disposed in said housing and means for rotating said anode dish around a rotational axis, said anode dish having an annular edge having an average radius with regard to said rotational axis, and said rotational axis being parallel to and offset from said beam axis by said average radius; and electromagnetic means for deflecting and focusing said electron beam onto said anode dish and for generating a dipole-free quadrupole field for deforming said cross-section of said electron beam.

2. An x-ray tube as claimed in claim 1 further comprising means connected to said electromagnetic means for setting a field strength of said dipole-free quadrupole field.

3. An x-ray tube as claimed in claim 1 further comprising a focusing electrode, separate from said electromagnetic means, and wherein said housing comprises a shoulder, in which said cathode and said focusing electrode are disposed, and a section containing said anode dish, said shoulder being provided with a constricted channel via which it is connected to said section, and wherein said electron beam passes through said channel.

4. An x-ray tube as claimed in claim 3 wherein said electromagnetic means comprises a plurality of coil elements in which current flows and a common carrier on which said coil elements are mounted, said common carrier at least partially surrounding said shoulder.

5. An x-ray tube as claimed in claim 4 wherein said carrier comprises a substantially cylindrical, divided ring.

6. A x-ray tube as claimed in claim 4 wherein said carrier comprises a plurality of pole projections extending toward said shoulder, said coil elements being respectively secured on said pole projections.

7. An x-ray tube as claimed in claim 6 wherein said carrier and said pole projections are comprised of laminated iron.

8. A x-ray tube as claimed in claim 6 wherein said carrier and said pole projections are comprised of solid iron.

9. An x-ray tube as claimed in claim 6 wherein said carrier and said pole projections are comprised of ferrite.

10. An x-ray tube as claimed in claim 4 wherein said carrier is comprised of laminated iron.

11. An x-ray tube as claimed in claim 4 wherein said carrier is comprised of solid iron.

12. An x-ray tube as claimed in claim 4 wherein said carrier is comprised of ferrite.

13. An x-ray tube as claimed in claim 1 further comprising means for supplying an alternating current to at least one of said coil elements and for supplying direct current to a remainder of said coil elements for generating said quadrupole field, for causing wobbling of a focal spot of said electron beam on said anode dish.

* * * * *